US005138820A

United States Patent [19]

Pearce et al.

[11] Patent Number: 5,138,820

[45] Date of Patent: Aug. 18, 1992

[54] LOW LEAKAGE GLAZING SYSTEM FOR SPACE FRAME STRUCTURES

[75] Inventors: Peter J. Pearce, Chatsworth; E. Leonard Pate, Los Angeles; Roger A. Conrad, Canoga Park, all of Calif.; William F. Dempster, Oracle, Ariz.

[73] Assignee: Space Biospheres Venture, Oracle, Ariz.

[21] Appl. No.: 482,105

[22] Filed: Feb. 16, 1990

[51] Int. Cl.[5] ..... E04C 2/38

[52] U.S. Cl. ..... 52/656; 52/761; 52/475

[58] Field of Search ..... 52/656, 657, 761, 474, 52/475, 762, 235, 398

[56] References Cited

U.S. PATENT DOCUMENTS

| | | | |
|---|---|---|---|
| Re. 30,432 | 11/1980 | Stoakes . | |
| 1,988,647 | 6/1934 | Emerson et al. | 108/16 |
| 2,662,745 | 12/1953 | Jorn et al. | 52/761 X |
| 2,800,308 | 7/1957 | Parkinson et al. | 52/761 X |
| 2,818,235 | 12/1957 | Baran | 52/761 X |
| 3,163,930 | 1/1965 | Stanley | 52/656 X |
| 3,785,104 | 1/1974 | Dailen . | |
| 4,050,498 | 9/1977 | Lucchetti | 52/657 X |
| 4,127,347 | 11/1978 | Pritchard | 52/657 X |
| 4,151,696 | 5/1979 | Knights et al. | 52/475 X |
| 4,215,675 | 8/1980 | Embree . | |
| 4,348,435 | 9/1982 | Mistrick et al. | 428/34 |
| 4,471,584 | 9/1984 | Dietrich . | |
| 4,500,572 | 2/1985 | Francis . | |
| 4,552,790 | 11/1985 | Francis . | |
| 4,557,089 | 12/1985 | Breithaupt . | |
| 4,581,868 | 4/1986 | McCann . | |
| 4,640,072 | 2/1987 | Muhle . | |
| 4,683,693 | 8/1987 | Rockar et al. | 52/198 |
| 4,704,839 | 11/1987 | Kay . | |
| 4,724,637 | 2/1988 | Evans . | |
| 4,799,344 | 1/1989 | Francis . | |
| 4,813,203 | 3/1989 | Newman et al. . | |
| 4,829,740 | 5/1989 | Hutchinson | 52/762 |
| 4,841,696 | 6/1989 | Miller | 52/656 X |

FOREIGN PATENT DOCUMENTS

| | | |
|---|---|---|
| 566813 | 8/1960 | Belgium . |
| 0130438 | 1/1985 | European Pat. Off. . |
| 0357260 | 3/1990 | European Pat. Off. . |
| 2924626 | 1/1981 | Fed. Rep. of Germany . |
| 30955 | 4/1985 | Fed. Rep. of Germany . |
| 3528388 | 2/1987 | Fed. Rep. of Germany . |

OTHER PUBLICATIONS

Brochure—Pearce Structures, "Integral Glazing Systems", 07820/PEA, BuyLine 4481, 4 pages.

Two Drawings—Pearce Structures—Integral Glazing System.

*Primary Examiner*—David A. Scherbel

*Assistant Examiner*—Kien Nguyen

*Attorney, Agent, or Firm*—Christie, Parker & Hale

[57] ABSTRACT

The substantially leak proof glazing system comprises a plurality of panels, each of which comprises a sheet of glass surrounded by a frame. The frame is formed of two angle members along each edge of the sheet which are slightly shorter than the edge of the sheet so that there is an open diagonal gap at the corner of the panel which leaves the corner open for receiving sealant. A resilient bezel is between each outer angle member and the outer surface of the corresponding sheet. The balance of the space between the edge of the sheet and the angle members is filled with a silicone sealant applied wet and cured in place. Channels in the faces of the bezel permit the detection of gas leakage through the seals. The glazing system has a generally U-shaped bond breaker covering a portion of the supporting structure. A quantity of silicone sealant is bonded between the edges of adjacent panels and the bond breaker, forming a substantially air tight seal between the panels. The bond breaker provides a surface which the sealant will not adhere to. The outer legs of the bond breaker are sinuous in transverse cross-section and elastically engage the supporting member and adjacent frames.

35 Claims, 4 Drawing Sheets

LOW LEAKAGE GLAZING SYSTEM FOR SPACE FRAME STRUCTURES

FIELD OF THE INVENTION

The present invention relates generally to the field of glazing systems and in particular to a system having a substantially air tight seal with leakage channels provided to enable measurement of air seepage.

BACKGROUND OF THE INVENTION

The Earth itself comprises a biosphere in which microorganisms, plants, and animals, including humans, exist in a more or less steady state, wherein matter is a finite resource which is continually recycled. There is continual energy input in the form of solar radiation. The quantity of matter gained or lost to space outside the Earth's atmosphere is minute. Thus, the Earth is a closed ecological system which may be referred to herein as Biosphere I.

It is desirable to provide a microcosm of the biosphere known as Earth for study of the interaction of components, and development of techniques for influencing our environment. Such experiments are difficult at best in the open system provided on Earth, where matter is exchanged between the Earth's environment and the experiment itself. It is, therefore, desirable to provide a system that is completely enclosed so that no matter is exchanged with the Earth's environment.

There is, therefore, being established near Oracle, Arizona, a completely closed ecological system referred to as Biosphere II. The system completely encloses about one hectare of land and 142,000 cubic meters of space isolated from the Earth's environment by an impermeable skin so that no matter is transferred. The above ground portion of the skin is transparent glass for receiving solar radiation. Electrical energy is provided to the closed system, and heat may be transferred to or from the system as required. Thus, the Biosphere II closed ecological system is closed as to matter, but open as to energy. For meaningful research, it also remains open for transfer of information.

The closed system should maintain an atmosphere with a composition suitable as a habitat for humans and other animals. For example, it is important to maintain the carbon dioxide concentration in the atmosphere within the closed ecological system within limits that are tolerable by the human and other animal occupants of the system, and provide for a desired steady state growth of plants for providing edible biomass and recyclable carbonaceous materials. To study the effects of various factors on the environment in the system it is of great importance that the impermeable skin of Biosphere II remain substantially completely sealed so that there is virtually no exchange of air between the inside and outside of the system.

The Biosphere II closed system has a large steel space frame erected on a concrete foundation. The space frame serves as support for a safety glass glazing system which provides the impermeable skin for the system. While glazing systems for use with space frame structures are known, a need exists for a glazing system providing an environmentally isolated enclosure which is virtually free of any leakage.

Such a glazing system should have a leakage rate not exceeding 1% per year of the enclosed volume of air. Considering the size of the structure and the miles of seals along the edges of glazing panels, this is a formidable challenge. An effective system should comprise panels and attachment elements capable of being mounted easily, quickly and safely to space frame structures and involve uncomplicated mounting structures and procedures. An effective system should also provide means to enable the detection of air seepage through the seals in the event it should occur.

SUMMARY OF THE INVENTION

Thus, in practice of this invention according to a presently preferred embodiment, there are provided a plurality of glazing panels in which a sheet of glass is sealed to a frame, and adjacent frames are sealed together to minimize the possibilities of air leakage. A glazing panel comprises a sheet of glass or the like and inner and outer metal angle members along the edges of the sheet. In transverse cross-section each angle member has first and second arms. The first arm of the inner angle member is disposed near the inner surface of the sheet, while the first arm of the outer angle member is disposed near the outer surface of the sheet. The second arms of the angle members, which extend substantially perpendicular to the panel are joined together for forming a frame for the glazing material.

An elastomeric bezel is placed between and in contact with the outer surface of the sheet and the first arm of the outer angle member. The remainder of the volume between the sheet and the angle members is filled with a resilient sealing material which adheres to the surfaces of the sheet and angle members. The bezel and the sealing material form a substantially air tight seal preventing the passage of air from the inner surface of the panel to its outer surface along the edge.

In transverse cross section in a preferred embodiment the bezel has shank, head and heel portions. The shank portion comprises two opposing substantially planar major surfaces in contact with the outer angle member and the outer surface of the sheet, respectively. The generally triangular head portion has tip and tail sections and extends from the end of the shank nearest the edge of the first arm of the outer angle member. The tail section of the head extends perpendicularly away from the shank such that the back face of the tail covers the edge of the first arm of the outer angle member. The head portion additionally has an arcuate inner surface extending from the planar inner surface of the shank portion to the tip of the head portion. When the arcuate shaped surface is placed in contact with and made to conform to the flat outer surface of the sheet, the force applied by the sheet causes the head portion to rotate. This rotation biases the edge of the tail section against the edge of the first arm of the outer angle member. The heel portion terminates the other end of the bezel. The heel portion is adjacent to and conforms to the inner surface of the junction of the first and second arms of the outer angle member.

The bezel additionally has at least two channels on its major surfaces extending the length of the bezel. These channels direct any gas leaking between the edge of the sheet and the frame to a portion of the bezel where it may be detected. The channels are formed in interfaces between the bezel and the panel and the bezel and the first arm of the outer angle member.

The glazing system comprises at least two glazing panels having substantially parallel edge connecting margins fastened to a supporting fin on the space frame of the structure and extending part way between the panels. The edge margin of the supporting fin is covered by a generally U-shaped bond breaker. The bond breaker provides a surface resistant to an adhesive sealing material between the adjacent panels. The bond breaker is preferably made of polypropylene or other resilient material and comprises a channel portion having a base and two side arms, and two side legs outside of the side arms. The channel portion fits tightly over with the edge margin of the supporting fin. The side arms of the channel are attached to the base and extend substantially parallel to the major surfaces of the supporting fin. The distance between the arms is greater at the base than at their ends creating an interference fit when the channel is engaged with the supporting fin. The side legs extend away from the base approximately parallel to the major surfaces of the supporting fin. The legs are far enough apart that they are compressed by the edge connecting margins of the panels joined to the supporting fin to prevent leakage of sealant as it is applied in an uncured state.

A plurality of bolts or rivets placed through the angle members along the edges of the glazing panels, the bond breaker and the supporting fin connect the panels to the fin. A quantity of elastomeric sealing material is bonded between the connecting edge margins of the glazing panels forming a substantially air tight seal between the panels. The sealing material may also be in contact with the bond breaker, however, due to the nature of the material comprising the bond breaker, negligible adhesion is created between the bond breaker and the sealing material. This eliminates a potential stress point for the sealing material if there is movement of the supporting fin relative to the edge margins of the panels.

In another aspect of the invention the corners of the angle members of the panel frame along the edges of the sheet are provided with vents so that sealant may be reliably introduced into the corner to avoid air bubbles in a blind corner and a potentially significant air leakage path. The angle members are connected to each other by a corner bracket which leaves the corner open for introduction of sealant.

BRIEF DESCRIPTION OF THE DRAWINGS

The foregoing and other advantageous and distinguishing features of the invention will be appreciated as the same becomes better understood by reference to the following detailed description when considered in connection with the accompanying drawings in which.

DETAILED DESCRIPTION

Figure 1:
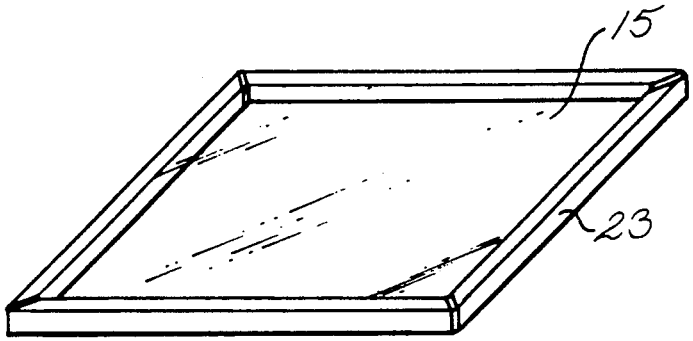
FIG. 1 is an isometric view of an exemplary glazing panel of this invention.

This invention involves a plurality of glazing panels each of which comprises a sheet of glazing material 15 such as laminated safety glass and a metal frame 19 sealed to the glass for mounting the panel as illustrated in FIG. 1. A number of these panels are sealed edge to edge to provide an air-tight closure of a structure such as Biosphere II where minimal air leakage can be tolerated. The glazing panels may be of rectangular, triangular or other required shape to cover the surface of the structure. The external face of the structure is formed of the glass panels without supporting mullions or the like exposed between the panels. The frames of adjacent panels are sealed to each other instead of to a supporting structure. Each glazing sheet may be glass, safety glass, plastic or other translucent or opaque material having a generally planar shape.

Figure 2:
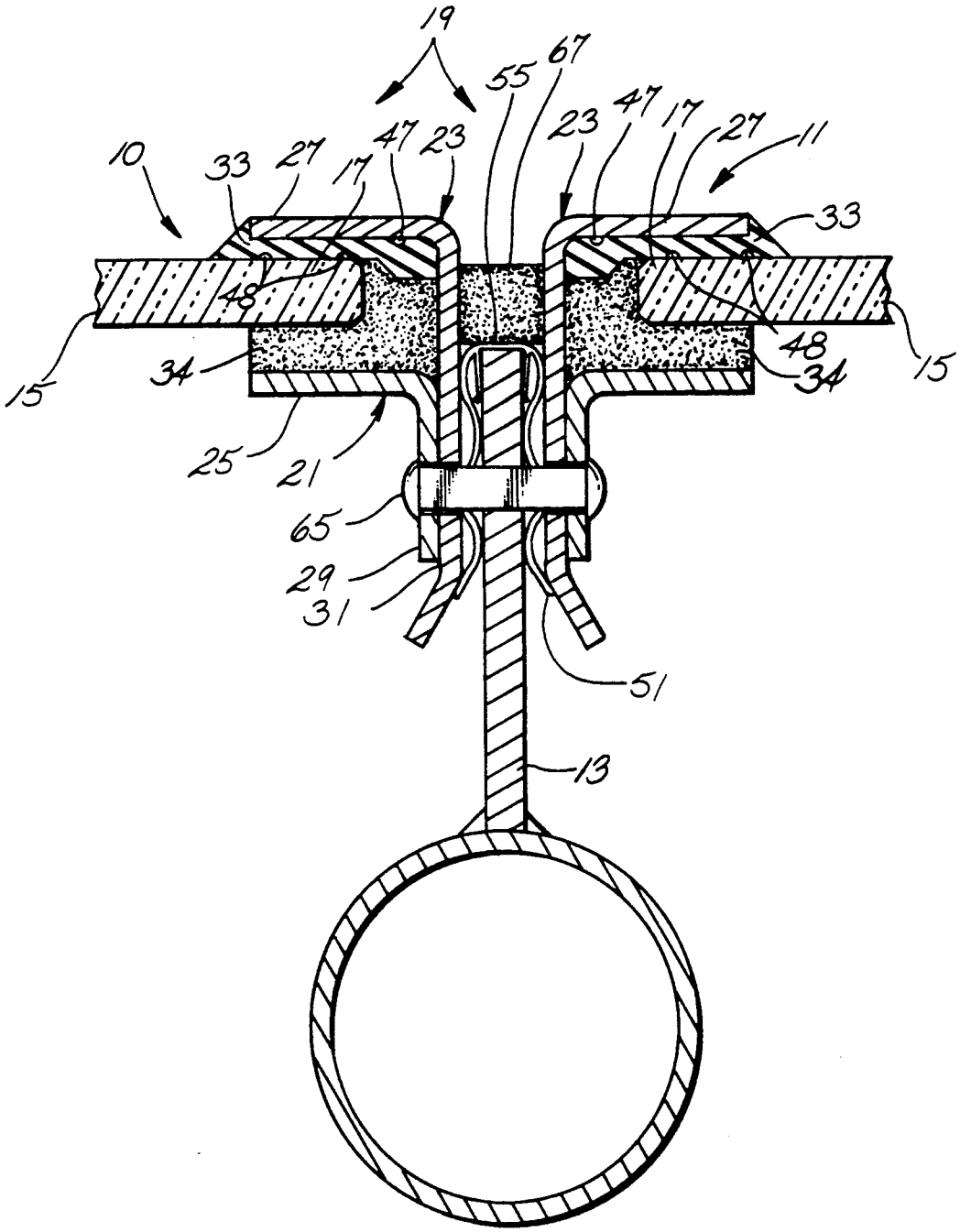
FIG. 2 is a transverse cross-section of the edges of two panels and a supporting member in a presently preferred embodiment of the invention.

The joint along the edge between two glazing panels 10, 11 is illustrated in transverse cross-section in FIG. 2. The panels are mounted on a supporting fin 13 which is on the space frame forming the internal skeleton of the structure. In the illustrated joint, the edges of the sheets of glass are parallel to each other and secured to the fin by way of connecting frames 19 bonded to the edge of the sheet.

The connecting frames 19 of the glazing panels each comprise an inner angle member 21 and an outer angle member 23, preferably of painted steel. First arms 25, 27 of the inner and outer angle members, respectively, are near the inner and outer surfaces, respectively, of the glazing sheet. The first arms 25, 27 are preferably parallel to, the surfaces of the glazing sheet. Second arms 29, 31 of the inner and outer angle members are joined together in a face-abutting relationship perpendicular to the plane of the glass.

An elongated extruded bezel 33 made of neoprene, silicone rubber or other deformable elastomeric material is between and in contact with the outer surface of the glass sheet and the inner surface of the first arm 27 of the outer angle member. The remainder of the volume between the edge of the glass and the inner and outer angle members is filled with a suitable quantity of a mastic-like wet elastomeric sealing material 34. By wet sealing material is meant a material which is a liquid or gel when uncured for wetting surfaces and which remains bonded to the wetted surfaces after curing.

A preferable wet sealing material is a single component silicone elastomer which is applied in a thick paste-like consistency, but which cures to a somewhat harder, but not fully hard, elastic and resilient condition, and which also bonds to most surfaces with which it is in contact. The result is a mechanically secured, substantially air-tight, and relatively flexible connection of each glazing sheet with the inner and outer angle members. A presently preferred sealant comprises Dow Corning 795 silicone since it does not require a primer on the bonding surfaces and can be applied rapidly and reliably.

Figure 3:
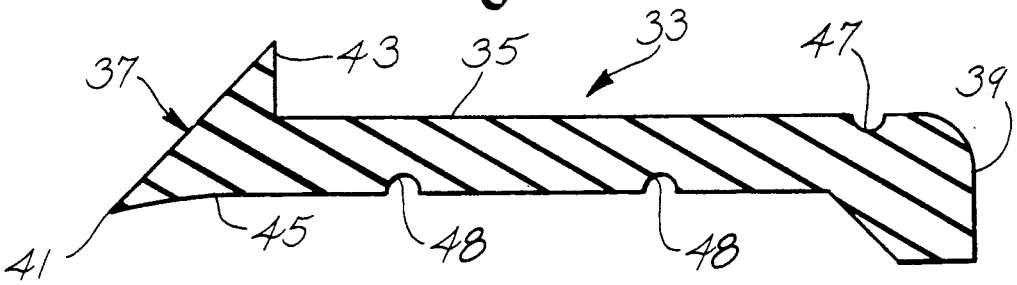
FIG. 3 is a transverse cross-section of one of the bezels shown in FIG. 2.

Referring additionally to FIG. 3, it may be seen that the cross-section of the bezel 33 is a complex shape having shank 35, head 37 and heel 39 portions. The shank portion 35 comprises substantially planar opposing major surfaces, which provide a tight seal when the bezel is between the inner surface of the first arm of the outer angle member 27 and the outer surface of the glass.

The portion of the shank 35 of the bezel extending away from the edge of the sheet toward the center of the sheet is terminated by the head portion 37. The head portion is generally triangular in cross-section, having a sharp tip 41 and a tail section 43. The tail section extends perpendicularly away from the outer surface of the shank 35 in contact with the outer angle member 23. The tail extends a distance sufficient to cover the edge of the first arm 27 of the outer angle member.

The inner face of the head, representing an extension of the planar surface of the shank in contact with the glazing sheet, is arcuate in shape and is terminated by the tip 41. A third surface of the triangular head extends between the tip 41 and the tail section 43 and may be of any convenient shape suitable for exposure to the elements. A preferable shape comprises a substantially flat surface forming an angle of about 45 relative to the outer surface of the glazing sheet.

In the course of positioning the bezel against the glazing sheet, the force applied by the sheet against the bezel's arcuate surface 45 causes the head to rotate slightly. This rotation biases the tail section 43 against the edge of the first arm 27 of the outer angle member, forming a weather-tight seal. This is significant for inhibiting trapping of moisture in this region, with consequent corrosion.

The heel portion 39 of the bezel terminates the edge of the shank 35 opposite from the head portion. The heel portion is adjacent to and conforms to the inner surface of the junction of the first and second arms 25, 27 of the outer angle member 23.

The bezel additionally has at least one channel 47 extending along the entire length of the interface between the bezel and the first arm 27 of the outer angle member 23, as well as at least one and preferably two channels 48, extending along the entire length of the interface between the bezel and the outer surface of the glazing sheet. The channels 47, 48 are preferably molded in the planar surfaces of the bezel and provide a pathway for any gas leaking through the seals along the edge of the panel. Any such leaking gas is channeled to the end of an edge of the frame where the leakage may be detected by suitable equipment.

The Biosphere II will have a positive internal pressure so that any leakage of gas will be from the interior of the structure to the exterior. The channel in the outer face of the bezel would intercept any leakage between the outer angle member and the silicone sealant 35. The outer channel 48 in the inner face of the bezel would intercept any leakage along the outer surface of the glass. The inner channel 48 in the inner face of the bezel would intercept any leakage along the inner surface of the glass and around the edge of the glass sheet.

The glazing system also comprises a generally U-shaped bond breaker 51 straddling the supporting fin 13. The supporting fin has an edge margin 55 extending between adjacent glazing panels 10 and 11. The fin 13 is preferably made of a metal having thermal expansion characteristics similar to the inner and outer angle members of the panel frame, such as steel. The fin is welded or otherwise affixed to a tubular member 54. The tubular member, fin and other supporting structure (not shown) comprise a space frame which collectively supports the glazing panels. The fin edge margin 55 is covered by the bond breaker 51. The bond breaker is preferably made of polypropylene, polyethylene, nylon or other resilient material having the characteristic of being resistant to attachment to adhesives and other bonding materials, and specifically is resistant to good adhesion by a silicone sealant applied between adjacent frames.

Figure 4:
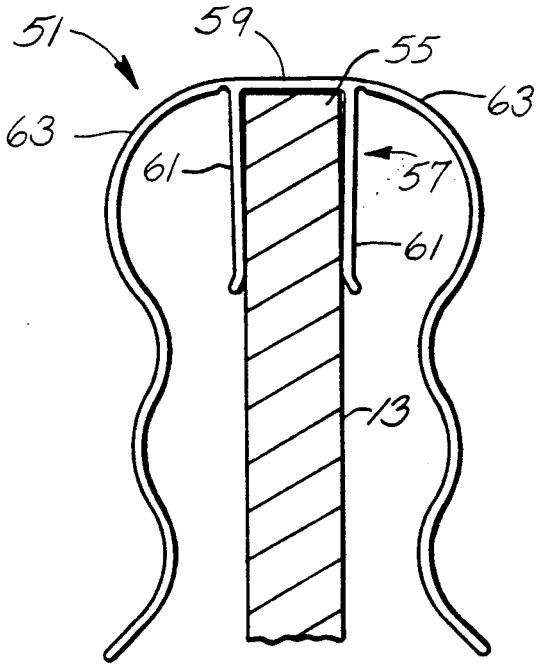
FIG. 4 is a transverse cross-section of a bond breaker shown in FIG. 1.

Referring now to FIG. 4, the bond breaker comprises a channel portion 57 having a base 59 and two side arms 61. The bond breaker additionally comprises two side legs 63 which extend outward from the base 59 outside of the side arms. The side arms extend perpendicularly from the base nearly parallel to the major surfaces of the fin 13. The distance between the side arms is slightly greater at their attachment point to the base 59 than at their ends. The distance between the side arms at their ends is preferably slightly smaller than the thickness of the fin, creating an interference fit between the supporting member and the fin when the bond breaker 51 is engaged on the edge margin 55 of the fin. This helps hold the bond breaker in place on the fin during assembly of the glazing on the space frame.

The side legs 63 extend initially outwardly from the base 59, then turn approximately 90° and extend approximately parallel to the major surfaces of the fin 13. Each of the legs is somewhat sinuous in transverse cross-section of the bond breaker. The sinuous legs act as springs when the frames are assembled on a fin.

As shown in FIG. 2, the side legs are compressed somewhat by contact with the outer angle member 23 when the glazing panels are joined to the bond breaker 51 and the supporting fin 13. The nominal space between each frame and the fin is about four millimeters. The bond breaker legs extend further than that from the fin. Thus, when a glazing panel is put in place on the space frame, the bond breaker tends to support the panel and prevent it settling between the fins. The lower edge of the outer angle member flares toward the center of the panel, so that the panel is more or less centered into the opening in the space frame during installation.

The panel is pushed into the space between fins, compressing the legs of each bond breaker toward the respective fin. The spacing is such that the legs elastically engage the side of the fin as well as the side of the outer angle member. The sinuous legs therefore act as springs tending to center the panel between the fins. Thus, the bond breakers serve functions in addition to preventing a bond to the sealant between frames. They also provide friction during installation of the panels, center the panels in the openings of the space frame, and fill gaps that would permit sealant to extrude between the fin and frame.

A plurality of bolts or rivets 65 placed at intervals through the inner and outer angle members 21, 23 and the supporting fin 13 join the glazing panels to the supporting fin.

When the two glazing panels have been mechanically secured in position on the support fin 13 through the use of a suitable number of rivets, there remains a space between the outer angle members 23 of the adjacent frames above the bond breaker 55. This space is filled by a suitable quantity of wet sealing material 67 applied in this space over the bond breaker. The sealing material preferably comprises a silicone elastomer having the same characteristics as the sealing material used to bond the edge margin of the glass to the inner and outer angle members. Preferably, the sealant is added in two passes, each of which applies about half of the sealant. The reliability of sealing is enhanced since it is quite unlikely that defects in both layers of sealant would coincide and provide a leak path through the joint.

The sealing material may cure in contact with the bond breaker, however, due to the nature of the material comprising the bond breaker, no or minimal adhesion is created between the bond breaker and the sealing material. This eliminates a potential stress point for the sealing material if there is movement of the supporting fin relative to the edge margins of the glazing panels. Such movement may be due to thermal expansion, wind pressure, earthquake or other external or internal forces. The result is a mechanically secured, weather-tight, substantially air-tight and relatively flexible connection of each glazing panel to the supporting member.

Figure 5:
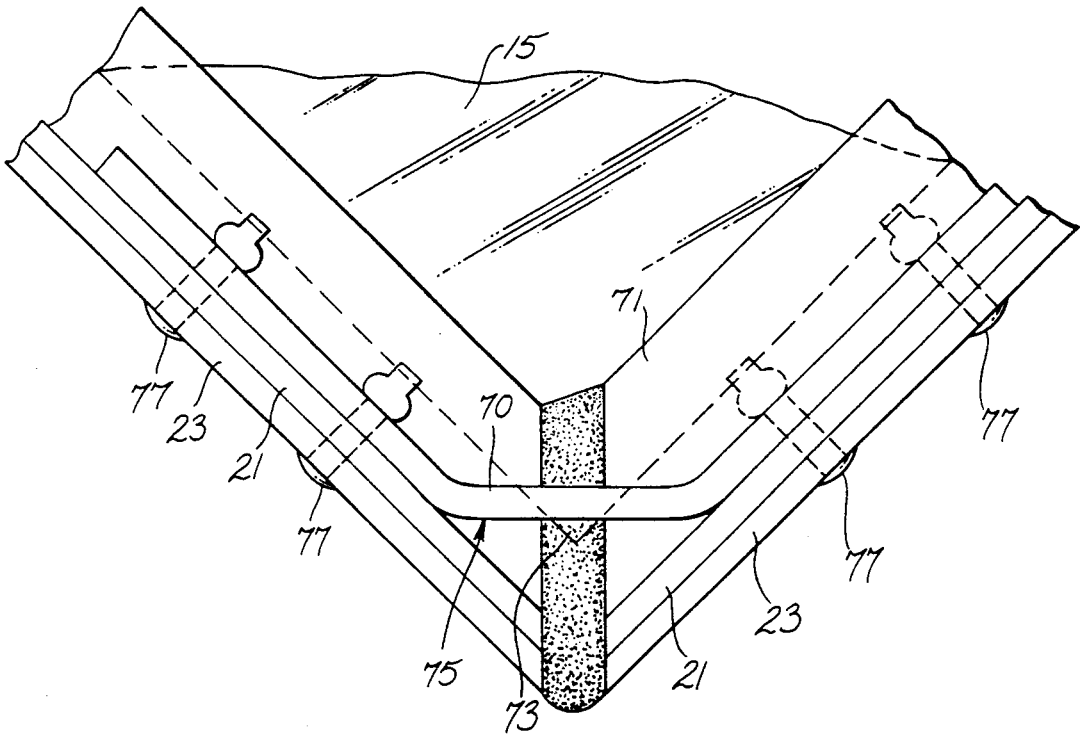
FIG. 5 is a plan view of a corner attachment which is another aspect of a presently preferred embodiment of the invention.

FIG. 5 is a plan view of the inside of one corner 73 of a single glazing panel illustrating the arrangement of the inner and outer angle members at the corner of the panel to assure that sealant completely fills the corner, avoiding a potentially troublesome leak path. The inner and outer angle members each have mitered ends near the corner of the glazing sheet 15. The elastomeric bezels (not shown in FIG. 5) are also mitered at the end. The length of each angle member is less than the length of the edge of the glass, so as to leave an open diagonal gap at the corner between the ends of the angle members.

The angle members are held in a fixed relationship with each other and the glass by a corner bracket 75 rigidly affixed to the angle members by rivets 77 or bolts. The corner bracket has two legs 69 which abut the inner angle members along their inner faces beyond the plane of the glass, and a diagonal connecting web 70 between the legs. The angle between the legs in the illustrated embodiment is 90° for a rectangular frame, but may be an acute or obtuse angle as required to fit the shape of the panel. For example, for the glazing system for the Biosphere II structure, the angles of the corner brackets range from 34° to 134° for assembling various polygonal panels. The bracket is steel having thermal expansion characteristics similar to the angle members. The bracket is below the second arm of the inner angle member, hence does not block the open corner gap between the ends of the angle members.

The space between the ends of the angle members is filled with a quantity of the sealing material 35 which seals the glass to the angle members, providing a substantially air-tight seal between the glazing sheet and the angle members. Since the corner is open, sealant can completely fill the volume of the corner. Absent this open space between the ends of the angle members, a blind corner is created between the angle members which can trap an air bubble and prevent sealant from complete filling, thereby leaving a potential leak path through the panel. This avoids problems which are encountered in completely sealing corners where adjacent frame members are welded together, are bent at the corner from a long angle member, have a blocking corner connector, or the like.

A panel is assembled by connecting the outer frame members at the corners with brackets. The bezels along the edges of the frame are cemented in place within the outer angle by a silicone adhesive. The sheet of glass or other glazing material is put in place. This assembly is done upside down so that the weight of the glass holds the assembly in place and pivots the head of the bezel. The inner angle is temporarily held in place or may be fixed to the outer angle. A layer of silicone sealant is then applied within the space between the angles and the glass. About half of the sealant is applied and at least partially cured. The balance of the sealant is applied in a second pass so that any pinholes in the sealant are not aligned in the two layers and reliable sealing is obtained.

Before the sealant is applied, a "plug" is placed in part of the open corner so that the end of the bezel is covered and sealant does not enter the channels in the bezel. The channels in the bezel can then be accessed at each corner of the frame for taking gas samples for leak detection. After assembly and sealing, each panel may be leak checked by applying a moderate pressure of argon or the like to the inside face of the panel. An argon sensitive leak detector is then used for detecting any leakage into the channels. The valley left in each corner gap when the plug is removed also provides a water drainage path past the outer arm of the outer angle member so that water doesn't puddle excessively on horizontal glazing panels.

Figure 6:
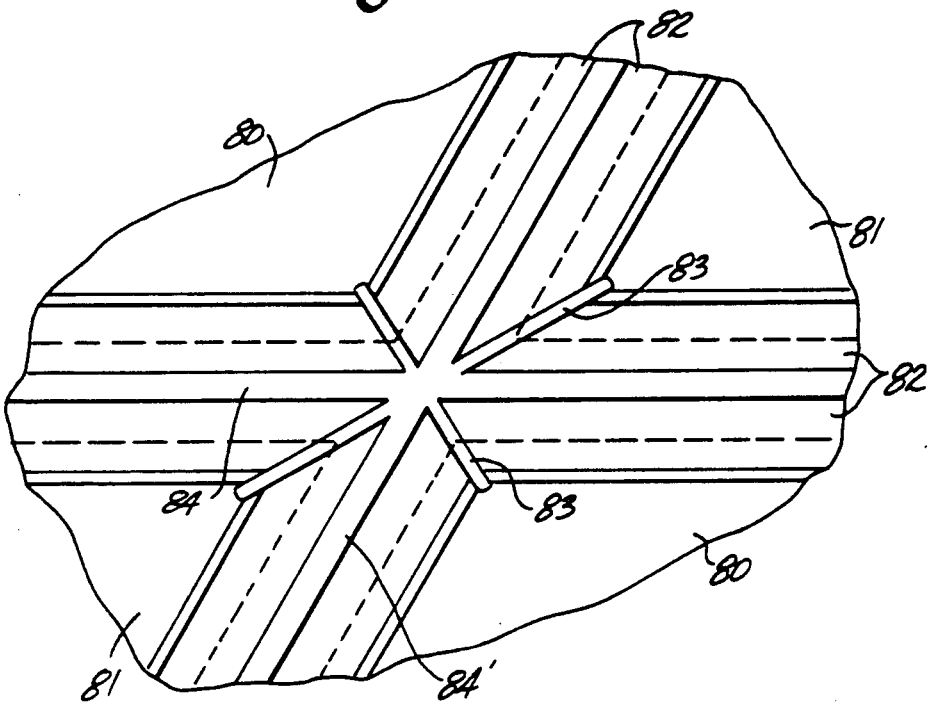
FIG. 6 is a plan view of another embodiment of corner connection between panels.

FIG. 6 illustrates another embodiment of corner joint where four panels meet at other than right angles. Such panels may be triangular or other polygonal shapes. At such a corner joint a pair of glazing panels 80 have obtuse angles in the corners and the adjoining panels 81 have acute angles in the corners. The frame angle members 82 around the glass sheets of the panels are mitered near the corner with a gap 83 between the ends of adjacent frame angle members for reliable introduction of sealant when the panel is fabricated. The ends of the angle members at the corner are connected together by bridging brackets (not shown) similar to the bracket 75 illustrated in FIG. 5. The space 84 between adjacent panels, including the central space in the corner joint, is filled with wet resilient sealant for sealing the panels to each other.

Figure 7:
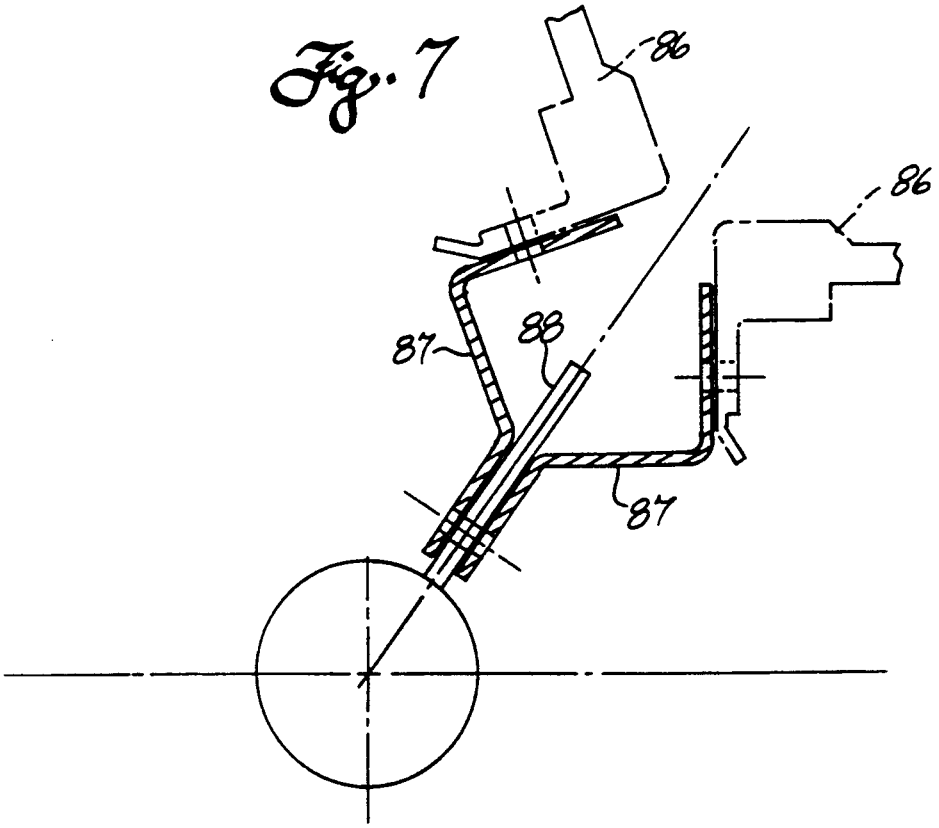
FIG. 7 is a transverse cross-section of another edge connection between glazing panels.

In other embodiments where adjacent panels are not in the same plane, special edge connection members are bolted or riveted to the supporting fin to provide a face normal to the plane of the glazing panel to which the frame angle members may be connected. For example, FIG. 7 illustrates somewhat schematically one joint configuration where adjacent panels 86 are not coplanar. A pair of edge connection members 87 are riveted to a supporting fin 88 on the space frame structure. The edge angle members of the panel frame are riveted to the edge connection members. Various other shapes of edge connection members are appropriate depending on whether the intersection of the panels is "concave" or "convex" and the relative angles. Also, specially shaped bond breakers, gap fillers, and corner pieces may be used for such edges where the glazing panels are not coplanar.

From the preceding description, it will be seen that this invention provides a low-leakage glazing system suitable for use with a space frame structure. These are illustrative arrangements of the invention and do not constitute an exhaustive catalog of all forms of the structural and procedural embodiments of this invention. Workers skilled in the art to which this invention pertains will appreciate that variations from or modifications in the arrangements described above can be practiced to use the principles and advances provided by this invention without departing from the scope of the invention. Accordingly, the following claims are to be read in this context and are to be given the broadest construction and interpretation which is properly affordable to them by the invention and the place it occupies in the relevant technology.

What is claimed is:

1. A glazing panel comprising:

a polygonal sheet of transparent glazing material;

a metal frame surrounding the sheet, the frame comprising members extending along each edge of the sheet, each frame member being spaced apart from an adjacent edge of the sheet, each frame member having mitered ends and having a length less than the length of the adjacent edge of the sheet, thereby leaving an open diagonal gap between the ends of the members at each corner of the panel;

means for connecting the ends of the frame members together at each corner without obstructing the open diagonal gap; and a resilient wet sealant filling space between the frame members and the edge of the sheet, including filling the diagonal gap at each corner of the panel.

2. A glazing system comprising a pair of glazing panels as recited in claim 1 and:

a supporting member, one glazing panel being on each side of the supporting member with panel frame members extending parallel to the supporting member;

means for securing the adjacent frame members to the supporting member; and a resilient wet sealant bonded to and interconnecting the adjacent frame members.

3. A glazing system comprising a plurality of panels as recited in claim 1 further comprising:

a supporting member between the edges of adjacent panels;

a generally U-shaped bond breaker over an edge of the supporting member; and a resilient sealant bonded to and extending between the edges of adjacent panels in contact with but not bonded to the bond breaker.

4. A glazing system as recited in claim 3 wherein the bond breaker comprises:

a pair of spaced apart arms for straddling and gripping the supporting member and a pair of spaced apart legs for engaging the frames of the glazing panels.

5. A glazing system as recited in claim 4 wherein the legs of the bond breaker are sinuous in transverse cross-section for elastically engaging both the frames and a face of the supporting member.

6. A glazing panel as recited in claim 1 wherein the frame comprises along each edge:

an outer angle member having an outer arm extending over and parallel to the outer surface of the sheet of glazing material and an inner arm normal to the outer arm;

an inner angle member having an outer arm extending parallel to the inner surface of the sheet of glazing material and spaced apart from the sheet of glazing material, and an inner arm normal to the outer arm; and means for connecting the inner arms of the inner and outer angle members together.

7. A glazing panel as recited in claim 1 comprising a resilient bezel extending along the length of each edge of the panel between the outer surface of the glazing material and the frame, a leak detecting channel extending along the length of the bezel, and a sufficient opening at the corner gap of the frame for obtaining a gas sample from the end of the channel.

8. The glazing panel of claim 1 comprising a resilient bezel extending along the length of each edge of the panel between the outer surface of the glazing material and the frame and comprising a generally triangular head portion extending beyond an edge of the frame and an arcuate surface engaging the outer face of the glazing material for rotating a face of the head portion against an edge of the frame.

9. A glazing panel comprising:

a sheet of transparent glazing material;

a metal frame surrounding the sheet, the frame comprising:

an outer angle member along each edge of the sheet having a first arm extending over an edge of the outer surface of the sheet and a second arm extending at an angle to the first arm, the length of the angle member being less than the length of the edge of the sheet, thereby leaving a gap at each corner of the panel;

an inner angle member along each edge of the sheet having a first arm extending over an edge of the inner surface of the sheet and a second arm extending at an angle to the first arm, the length of the angle member being less than the length of the edge of the sheet, thereby leaving a gap at each corner of the panel;

means for securing the second arms of the inner and outer angle members together; and a corner bracket at each corner of the panel securing the angle members together while still leaving a gap at the corner;

a resilient bezel along each edge of the sheet between the first arm of the outer angle member and the outer surface of the sheet; and a resilient sealant filling the balance of the space between the angle members and the edge of the sheet and filling the corner gaps.

10. A glazing system comprising a plurality of panels as recited in claim 9 further comprising:

a supporting member between the edges of panels;

a generally U-shaped bond breaker over an edge of the supporting member; and a resilient sealant bonded to and extending between the edges of adjacent panels in contact with but not bonded to the bond breaker.

11. A glazing system as recited in claim 10 wherein the bond breaker comprises:

a pair of spaced apart arms for straddling and gripping the supporting member and a pair of spaced apart legs for engaging the frames of the glazing panels.

12. A glazing system as recited in claim 11 wherein the legs of the bond breaker are sinuous in transverse cross-section for elastically engaging both the frames and a face of the supporting member.

13. A glazing panel as recited in claim 9 wherein the bezel comprises a strip extending along the length of the edge of the panel and including an outer longitudinal leak detection channel adjacent to the first arm of the outer angle member and an inner leak detection channel adjacent to the outer surface of the glazing material.

14. A glazing panel as recited in claim 13 further comprising a sufficient gap at the corner of the frame for obtaining access to the end of each channel for collecting a gas sample from such a channel.

15. A glazing panel comprising:

a sheet of glazing material having an edge margin, an inner surface and an outer surface;

a frame member along the edge margin of the sheet;

means for sealing the frame member and the edge margin of the sheet for substantially preventing the passage of air from the inner surface to the outer surface of the sheet between the sheet and the frame member; and channel means for channeling gas leaking past a surface of the sealing means, toward an end of the frame member, the surface of the sealing means being adjacent to the frame member or adjacent to the sheet.

16. A glazing panel as recited in claim 15 wherein the means for sealing and channeling comprises an elastomeric bezel having a longitudinally extending channel along its outer face and a longitudinally extending channel along its inner face, the inner and outer faces being arranged against the frame member and against the sheet.

17. A glazing panel as recited in claim 16 wherein the means for sealing also comprises an elastomeric wet sealing filling the balance of the space between the frame member and the sheet.

18. A glazing panel comprising:

a sheet of glazing material having an edge margin, an inner surface and outer surface;

an inner angle member and an outer angle member along the edge margin of the sheet, a first arm of the inner angle member being near the inner surface of edge margin of the sheet, a first arm of the outer angle member being near the outer surface of the edge margin of the sheet, the second arm of the inner angle member and the second arm of the outer angle member being connected together;

a quantity of resilient sealing material placed between the sheet and the angle members forming a substantially air tight seal therebetween; and means for channeling any gas leaking between the sheet and the angle members toward an end of one of the angle members.

19. The glazing panel of claim 18 wherein the means for channeling comprises a resilient bezel between the outer surface of the sheet and the outer angle member and having at least one leak detection channel extending along its length.

20. The glazing panel of claim 19 wherein the resilient bezel comprises a generally triangular head portion extending beyond an edge of the outer angle member and an arcuate surface engaging the outer face of the glazing material for rotating a face of the head portion against an edge of the outer angle member.

21. The glazing panel of claim 18 comprising a resilient bezel between and in contact with the outer surface of the sheet and the outer angle member, the bezel comprising in transverse cross-section:

a shank portion, having opposite first and second major surfaces, the major surfaces extending along the edge of the sheet in a face abutting relationship with the outer angle member and the outer surface of the sheet, respectively;

a head portion, having tip and tail sections, extending away from the shank toward the center of the sheet, the tail section terminating the shank and extending laterally away from the first major surface such that the end of the tail covers the edge of the first arm of the outer angle member, the head portion additionally having an arcuate shaped surface extending between the portion of the tail section terminating the second surface of the shank and the tip such that when the arcuate surface is made to conform to the outer surface of the sheet, the head portion is rotated, biasing the end of the tail section against the edge of the first arm of the outer angle member; and a heel portion at the other end of the shank from the head, the heel portion being adjacent to and adapted to conform to the inner surface of the intersection of the first and second arms of the outer angle member.

22. The glazing panel of claim 21 wherein the gas channeling means comprises at least two channels extending the length of the bezel, the first channel being in the interface between the bezel and the outer surface of the sheet, and the second channel being in the interface between the bezel and the outer angle member.

23. The glazing panel of claim 22 wherein the channels are recessed in the opposite major surfaces of the bezel.

24. A glazing system comprising:

at least a pair of adjacent glazing panels, each panel comprising a sheet of glazing material and a surrounding metal frame;

a supporting member between the panels and connected to the frames of the panels; and a generally U-shaped bond breaker straddling the supporting member comprising:

a pair of inner arms engaging an edge of the supporting member for at least temporarily securing the bond breaker on the supporting member; and a pair of outer legs between the supporting member and the adjacent frames.

25. A glazing system as recited in claim 24 wherein the outer legs of the bond breaker are sinuous in transverse cross-section.

26. A glazing system as recited in claim 24 wherein each outer leg of the bond breaker is in elastic engagement between the supporting member and the adjacent frame for biasing the frames away from the supporting member.

27. A glazing system comprising:

at least two glazing panels having substantially parallel connecting edge margins;

a supporting fin between the connecting edge margins of the glazing panels;

a generally U-shaped bond breaking means over the supporting fin for providing a bond resistant surface, the bond breaking means comprising a pair of spaced apart arms for straddling the supporting fin and a pair of spaced apart legs for engaging the connecting edge margins of the glazing panels;

means for joining the connecting edge margins of the glazing panels to the supporting fin with the bond breaking means therebetween; and a quantity of wet sealing material adjacent the bond breaking means, bonded between the connecting edge margins of the glazing panels, such that a substantially air tight seal is formed between the panels without bonding to the bond breaking means.

28. The glazing system of claim 27 wherein the bond breaking means comprises:

a resilient channel portion having a base and two side arms, the side arms engaged with the edge margin of the supporting fin; and two resilient side legs extending away from the base nearly parallel to the major surfaces of the supporting fin, the legs being positioned such that they are compressed by the edge connecting margins of the panels when the edge connecting margins are joined to the bond breaking means and the supporting fin.

29. The bond breaking means of claim 28 wherein the two side arms extend away from the base at an angle such that the distance between the arms at their ends is less than that at the base, the distance between the arms at their ends also being sufficiently less than the width of the supporting fin to create an interference fit when the channel is engaged with the fin.

30. The bond breaking means of claim 27 wherein the side legs are flared away from the supporting member near their ends.

31. The bond breaking means of claim 27 wherein the side legs are sinuously curved along their length.

32. The glazing system of claim 27 wherein each of the panels comprises:

a sheet of glazing material having an edge margin, an inner surface and an outer surface;

an inner and an outer angle member along the edge margin of the sheet, a first arm of the inner angle member being near the inner surface of the sheet, a first arm of the outer angle member being near the outer surface of the sheet, a second arm of the inner angle member and a second arm of the outer angle member being joined together;

a quantity of resilient sealing material bonded between the sheet and the angle members forming a substantially air tight seal therebetween; and means for channeling gas leaking between the sheet and the angle members toward an end of one of the angle members.

33. The glazing system of claim 32 further comprising a bezel placed between and in contact with the outer surface of the sheet and the outer angle member, the bezel comprising in transverse cross-section:

a shank portion, having opposite first and second major surfaces, the major surfaces extending along the edge of the sheet in a face abutting relationship with the outer angle member and the outer surface of the sheet, respectively;

a head portion, having tip and tail sections, extending away from the shank toward the center of the sheet, the tail section terminating the shank and extending laterally away from the first major surface such that the end of the tail covers the edge of the first arm of the outer angle member, the head portion additionally having an arcuate shaped surface extending between the portion of the tail section terminating the second surface of the shank and the tip such that when the arcuate surface is made to conform to the outer surface of the sheet, the head portion is rotated, biasing the end of the tail section against the edge of the first arm of the outer angle member; and a heel portion at the other end of the shank from the head, the heel portion being adjacent to and adapted to conform to the inner surface of the intersection of the first and second arms of the outer angle member.

34. The glazing panel of claim 32 wherein the gas channeling means comprises at least two channels extending the length of the bezel, the first channel being in the interface between the bezel and the outer surface of the sheet, and the second channel being in the interface between the bezel and the outer angle member.

35. The glazing system of claim 34 wherein the channels are recessed in the surface of the bezel.

* * * * *